US011413590B2

(12) United States Patent
Cain

(10) Patent No.: US 11,413,590 B2
(45) Date of Patent: Aug. 16, 2022

(54) CHEMICAL MIXER TOOL FOR USE IN A STORAGE DRUM

(71) Applicant: Stephen Cain, Castle Rock, CO (US)

(72) Inventor: Stephen Cain, Castle Rock, CO (US)

( * ) Notice: Subject to any disclaimer, the term of this patent is extended or adjusted under 35 U.S.C. 154(b) by 443 days.

(21) Appl. No.: 16/737,555

(22) Filed: Jan. 8, 2020

(65) Prior Publication Data

US 2020/0139317 A1 May 7, 2020
US 2021/0138414 A9 May 13, 2021

Related U.S. Application Data

(63) Continuation-in-part of application No. 16/153,326, filed on Oct. 5, 2018, now abandoned, and a continuation-in-part of application No. 16/053,984, filed on Aug. 3, 2018, now abandoned.

(60) Provisional application No. 62/801,712, filed on Feb. 6, 2019, provisional application No. 62/775,956, filed on Dec. 6, 2018, provisional application No. 62/540,825, filed on Aug. 3, 2017.

(51) Int. Cl.

| | |
|---|---|
| ***B01F 27/00*** | (2022.01) |
| ***B01F 27/91*** | (2022.01) |
| ***B65D 1/16*** | (2006.01) |
| ***B01F 27/09*** | (2022.01) |
| ***B01F 27/113*** | (2022.01) |
| ***B01F 35/53*** | (2022.01) |
| ***B01F 35/00*** | (2022.01) |
| ***B01F 35/41*** | (2022.01) |
| *B01F 35/30* | (2022.01) |

(52) U.S. Cl.
CPC ..... *B01F 27/91* (2022.01); *B01F 27/09* (2022.01); *B01F 27/113* (2022.01); *B01F 35/189* (2022.01); *B01F 35/4111* (2022.01); *B01F 35/53* (2022.01); *B65D 1/16* (2013.01); *B01F 2035/352* (2022.01)

(58) Field of Classification Search
CPC ..... B01F 27/91; B01F 35/4111; B01F 27/113; B01F 35/53; B01F 27/09; B01F 35/189; B01F 2035/352; B65D 1/16
See application file for complete search history.

(56) References Cited

U.S. PATENT DOCUMENTS 5,251,979 A * 10/1993 Larsen ..... B01F 27/88 366/279
2005/0088907 A1* 4/2005 Vanek ..... B01F 27/113 366/342
2005/0166741 A1* 8/2005 Kopras ..... B25F 5/02 83/745

* cited by examiner

*Primary Examiner* — Anshu Bhatia
(74) *Attorney, Agent, or Firm* — Leyendecker & Lemire

(57) ABSTRACT

A chemical mixer tool for use in a storage drum is described. The chemical mixer tool typically comprises a mixer housing assembly in which one end of a mixer shaft is secured, the distal end of the mixer shaft having at least one collapsible impeller assembly removably attached thereon. The chemical mixer tool is configured to be removably secured to the top portion of the storage drum, with the distal end of the mixing shaft extending into the interior of the storage drum.

14 Claims, 9 Drawing Sheets

CHEMICAL MIXER TOOL FOR USE IN A STORAGE DRUM

CROSS-REFERENCE TO RELATED APPLICATION

The present application claims the benefit of and priority to U.S. Provisional Patent Application No. 62/801,712, filed on Feb. 6, 2019, entitled "Diptube End Fitting with Bellows For Use With Chemical Storage Containers," U.S. patent application Ser. No. 16/153,326, filed Oct. 5, 2018, entitled "Drum Assembly," U.S. patent application Ser. No. 16/053,984, filed on Aug. 3, 2018, entitled "Chemical Mixer Tool and Drum Assembly," which claimed priority to U.S. Provisional Patent Application No. 62/540,825, filed on Aug. 3, 2017, the entire contents of which are hereby incorporated by reference.

BACKGROUND

A drum or barrel is a cylindrical container that is commonly used for shipping bulk cargo. Drums are typically single-piece, and can be made of steel, dense paperboard (commonly called a fiber drum), or plastics. Drums are generally used for the transportation and storage of liquids or powders, and are commonly used for the transportation and storage of industrial chemicals, fuels, and oils, as well as in agricultural environments. Often times, drums used for these purposes must be certified for use with particular industrial chemicals. In these cases, the goods shipped must be matched with the make of drum that is necessary to comply with applicable regulations.

In industrial and agricultural settings, multiple drums are typically shipped or transported to a single location. Several drums are therefore often placed in storage until the contents within are needed. Drums commonly have both a flat top surface and bottom surface, which enables the drums to be stacked while in storage. However, any fittings that the drum may be outfitted with must also be flat, otherwise they may be damaged during transport or storage, which may cause unwanted and dangerous leakage of the drum's liquid contents.

Often in industrial settings various chemicals need to be controlled in certain proportions to enable a particular result. Different mechanisms exist which allow for the combination and mixing of chemical compounds, which are often part of a large processing facility. However, there are occasions when humans must directly mix such chemicals, and the need to remove and re-insert mixer attachments can expose the user to drips, leaks, and fumes during transfer. Additionally, when extracting liquid from a traditional drum, liquid often times pools in the base of the drum in a manner that evades extraction, and remains left-behind in the drum, and is therefore unusable and wasted.

DETAILED DESCRIPTION

Figure 1:
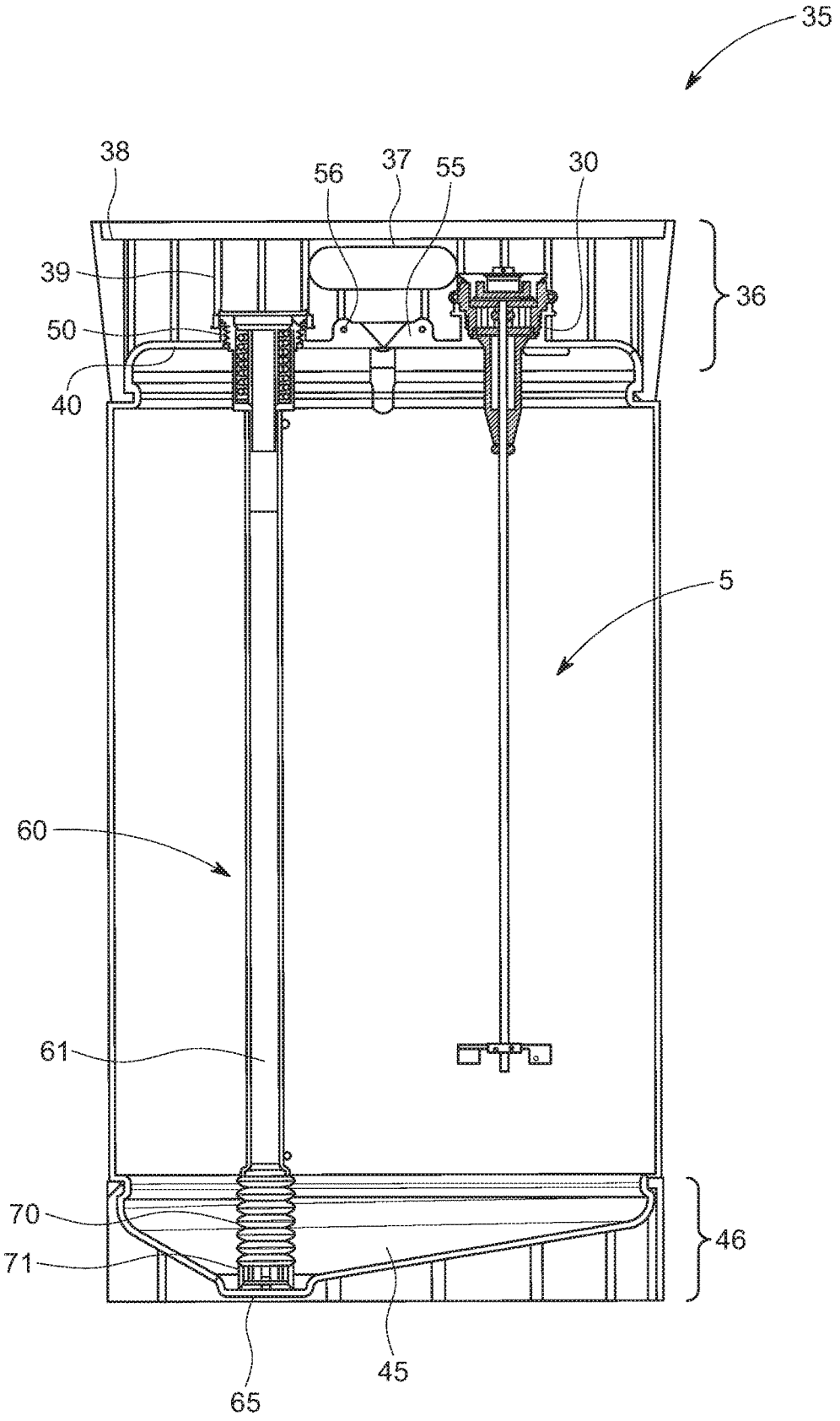
FIG. 1 is a front view of a storage drum according to one embodiment of the present invention.
Figure 2:
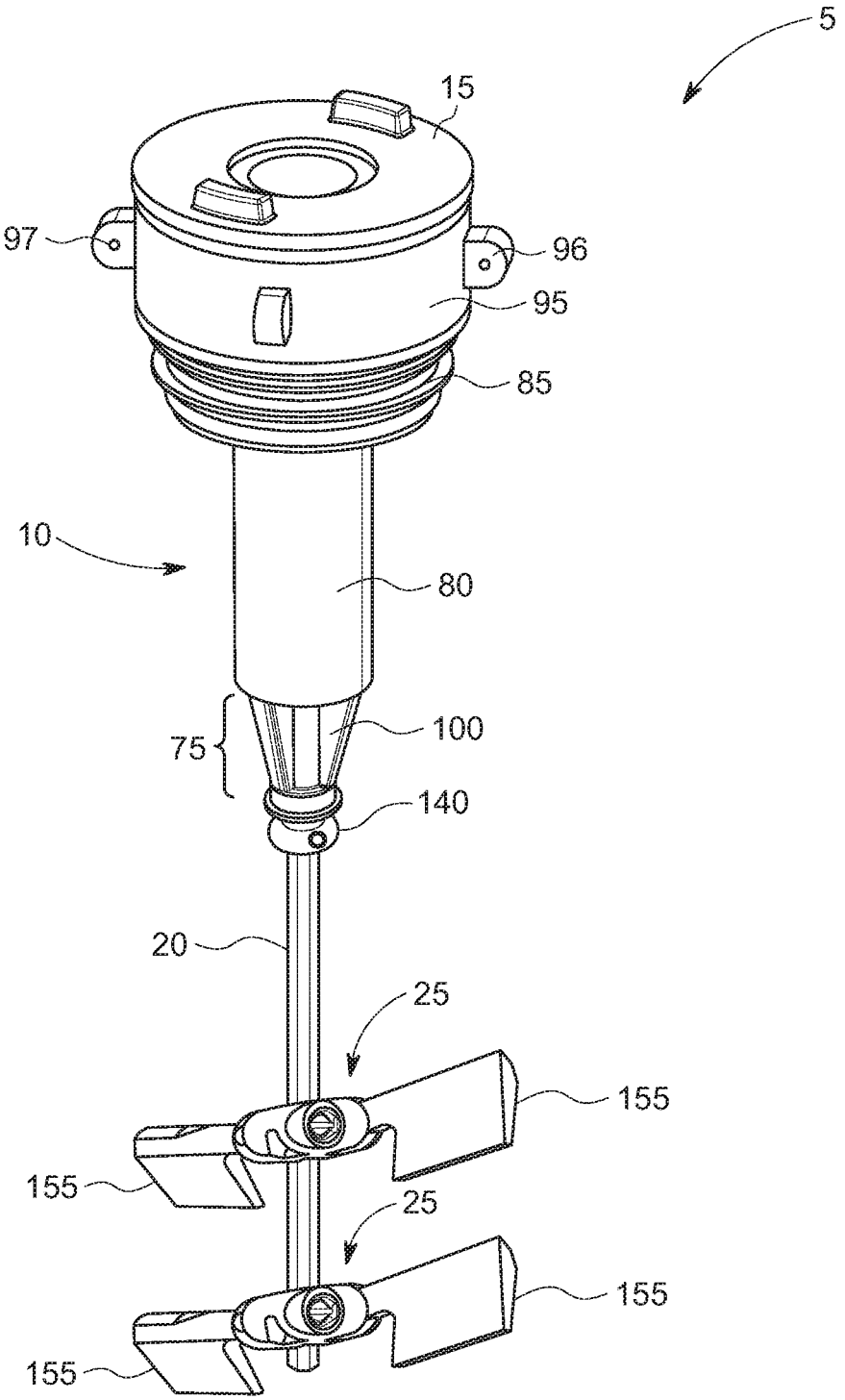
FIG. 2 is a front view of a chemical mixer tool according to one embodiment of the present invention.

Embodiments of the present invention comprise a chemical mixer tool for use in a storage drum, the chemical mixer tool having a mixer housing assembly in which one end of mixer shaft is secured, with the distal end of the mixer shaft having at least one impeller assembly removably attached thereon. Typically, the chemical mixer tool is removably secured within a port of a chemical storage drum. The chemical mixer's impeller assembly is designed to collapse when not in use, allowing the chemical mixer tool to be removable from the chemical storage drum without having to limit the radial length of the impeller assembly's pitch blades. This allows for the chemical mixer tool to be removable without sacrificing its mixing efficiency. Additionally, the chemical mixer tool is configured to create a closed system, which allows for more control over chemical purity from the point-of-origin to the point-of-use, as well as minimizing the risk of chemical exposure to the user.

The storage drum is designed to optimize efficient storage, as well as liquid extraction. The storage drum comprises a base having a generally conical sump portion with a frustum base. The downwardly angled slope of the conical sump directs the liquid to flow into the frustum base, which is positioned directly below a pump valve port. This arrangement reduces the amount of liquid which would otherwise remain behind in a typical storage drum following extraction. Furthermore, the storage drum features an extended upper chime with a support lip. The support lip allows for the storage drums to be stacked when not in use. Additionally, the extended length of the upper chime enables the attachments secured within the port or ports of the storage drum to remain in place and protected from damage when the drums are stacked, for optimal and efficient storage.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment," "an embodiment," "another embodiment," "a preferred embodiment," "an alternative embodiment," "one variation," "a variation," and similar phrases mean that a particular feature, structure, or characteristic described in connection with the embodiment or variation is included in at least an embodiment or variation of the invention. The phrase "in one embodiment," "in one variation," or similar phrases as used in various places in the specification are not necessarily meant to refer to the same embodiment or the same variation.

The term "couple" or "coupled," as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional or relationary terms including but not limited to, left, right, nadir, apex, top, bottom, vertical, horizontal, back, front, and lateral are relative to each other and are dependent on the specific orientation of a applicable element or article, and are used accordingly to aid in the description of the various embodiments and are not necessarily intended to be construed as limiting.

An Embodiment of a Chemical Mixer Tool for Use in a Storage Drum

A chemical mixer tool 5 is illustrated in FIGS. 1-5. Typically, the chemical mixer tool 5 includes a mixer housing assembly 10, a vent cap 15, a mixer shaft 20, and an impeller assembly 25. The chemical mixer tool 5 is structured and arranged in a manner as to enable the impeller assembly 25 to be inserted through a mixer port 30 into a storage drum 35 and secured in place by attaching the mixer housing assembly 10 to the storage drum's 35 mixer port 30.

As shown in FIG. 1, the storage drum 35 has an interior storage volume defined by an outer wall having a first and second end, and is typically substantially cylindrical. The storage drum 35 typically has a generally flat top portion 40 attached to the first end of the outer wall, and a bottom sump portion 45 attached to the second end. Extending in the proximal direction around and outwardly away from top portion 40 of storage drum 35 is upper chime 36, having a plurality of support ribs 39 circumferentially and externally disposed, and a support lip 38 circumferentially and internally disposed near the proximal end of upper chime 36. Upper chime 36 may further include a pair of oppositely opposed hand grip holes 37, to allow for manual lifting of storage drum 35. Support ribs 39 reinforce and strengthen upper chime 36, increasing the drop protection performance of storage drum 35.

Lower chime 46 circumferentially surrounds and extends downwardly from bottom sump portion 45. The bottom sump portion 45 is conically tapered, and therefore presents an uneven surface for storage drum 35 to rest upon. The addition of lower chime 46 thus provides an even, stable resting surface for storage drum 35. The width of upper chime 36 and lower chime 46 is sufficiently thick so as to support the weight of one or more storage drums 35.

The distal end of lower chime 46 is sized to sit partially within upper chime 36, resting securely on support lip 38 of upper chime 36. This enables a plurality of storage drums 35 to be securely stacked on top of one another, or with other drums, allowing for storage drums 35 to be compactly and efficiently stored as needed. Support ribs 39 reinforce and strengthen upper chime 36, thus increasing stability of storage drum 35 when stacked with other storage drums. Additionally, upper chime 36 extends sufficiently upwards, and support lip 38 is positioned on upper chime 36, so as to allow clearance for the attachments that may be secured within pump valve port 50 and mixer port 30. This enables the storage drums 35 to be stacked and stored without having to remove any port attachments. This allows for the chemical mixer tool 5 and the storage drum 35 to create a closed system, which protects the contents of the storage drum 35 from contamination and the user from potential dangerous chemical or vapor exposure.

As shown in FIG. 1, the top portion 40 of storage drum 35 typically has a pump valve port 50, a mixer port 30, and a security tab 55. The pump valve port 50 and the mixer port 30 are typically threaded so as to enable associated attachments to be secured therein. In the exemplary embodiment shown in FIG. 1, a pump assembly 60 is threadably received and secured to the pump valve port 50, and the mixer housing assembly 10 is threadably received and secured to the mixer port 30.

Typically, the pump valve port 50 and the mixer port 30 are off-set from the center of the top portion 40, with the security tab 55 located therebetween. The off-centered arrangement of the pump valve port 50 and the mixer port 30 allow for the chemical mixer tool 5 to be sufficiently distanced from the pump assembly 60 to ensure the chemical mixer tool 5 can create the necessary flow pattern to efficiently mix the liquid within the storage drum 35. The security tab 55 comprises a protrusion from top portion 40, having at least two bored holes 56 for securing a tamper-resistant device therein. The tamper-resistant device is simultaneously secured to both the bored holes 56 of security tab 55 and the bored holes 97 of grip tab 96, thereby allowing a user to be alerted in instances where an attachment has been unwantedly removed from its associated port.

The bottom sump portion 45 is typically an oblique cone with a frustum base 65 that is substantially parallel to the support lip 38 of upper chime 36. As shown in FIG. 1, the frustum base 65 is positioned directly below the pump valve port 50. Typically, the pump assembly 60 comprises a pump tube 61 and a dip tube fitting 70 having bellows 71. Typically, the distal end of the pump tube 61 extends to the frustum base 65 once the pump assembly 60 is secured to the pump valve port 50. When the dip tube fitting 70 having bellows 71 is coupled with the distal end of the pump tube 61, the distal end of bellows 71 contact and rest in the frustum base 65.

As stored liquid is extracted from the storage drum 35, the downward slope of the oblique conical shape of the bottom sump portion 45 directs the flow of the remaining liquid into the frustum base 65. At its steepest, typically the oblique cone of the bottom sump portion 45 slopes downwardly at an angle of approximately thirty-five degrees. At its shallowest, typically the oblique cone of the bottom sump portion 45 slopes downwardly at an angle of approximately fifteen degrees. The substantially horizontal flat surface of the frustum base 65 allows for the dip tube fitting 70 having bellows 71 to sit flush with the frustum base 65. This arrangement allows for the pump assembly 60, when activated, to extract nearly all of the stored liquid within the storage drum 35, as the remaining liquid is directed into the frustum base 65 wherein the pump assembly 60 is situated, and flows through the bellows 71 into the pump tube 61.

Figure 6:
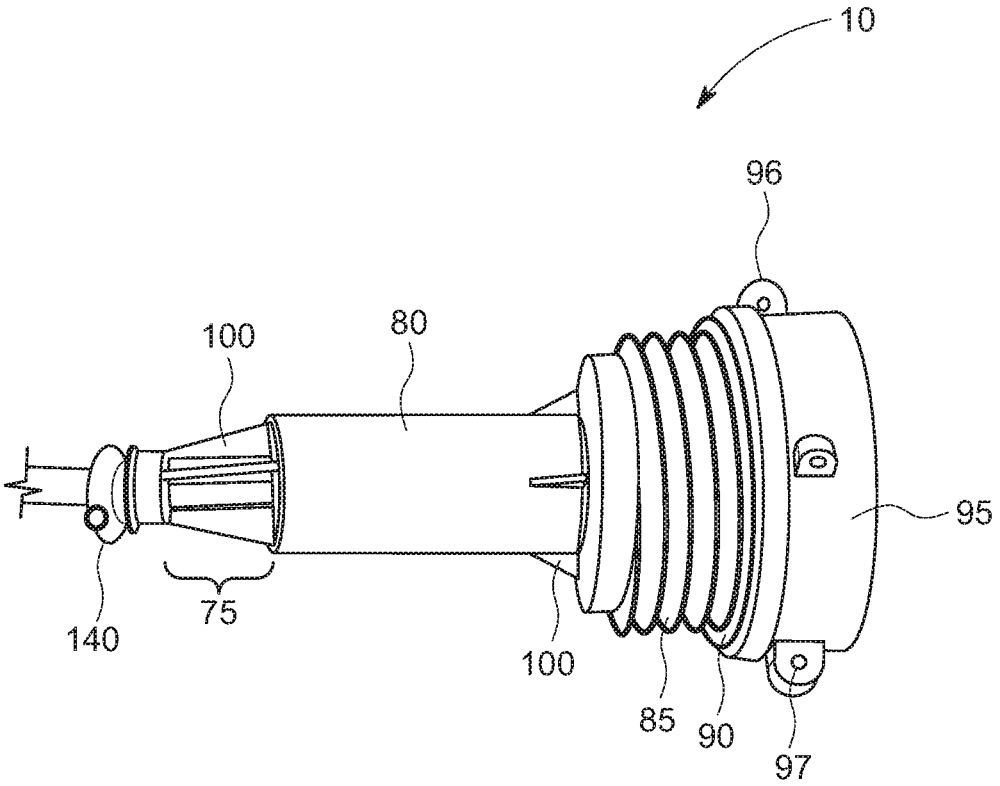
FIG. 6 is a side cut-away view of a mixer housing assembly of a chemical mixer tool according to one embodiment of the present invention.

As shown in FIG. 6, the mixer housing assembly 10 typically comprises a mixer head stem 75, a cylindrical bearing housing 80, a port engagement interface 85, a port gasket 90, and a grip ring 95. The cylindrical bearing housing 80 extends between the port engagement interface 85 and the mixer head stem 75 and is smaller in diameter than the port engagement interface 85 and typically larger in diameter than the mixer head stem 75. To strengthen the joints at which the cylindrical bearing housing 80 meets the port engagement interface 85 and the mixer head stem 75, a plurality of strengthening buttresses 100 are typically radially disposed around each joint, as shown in FIG. 6. Grip ring 95 has a plurality of grip tabs 96, each grip tab 96 having a bored hole 97 for attaching a tamper-resistant device therein. Together, the mixer head stem 75, cylindrical bearing housing 80, port engagement interface 85, and grip ring 95 comprise the mixer housing. Typically, the mixer housing is a single injection molded piece, which eliminates the risk of potential weak points typically created when welding multiple pieces together. The single injection molded piece also reduces waste and post-production trimming work which can result from the injecting molding process. The mixer housing is typically formed from a chemical and heat resistant material, such as glass fiber-reinforced polypropylene.

Figure 7:
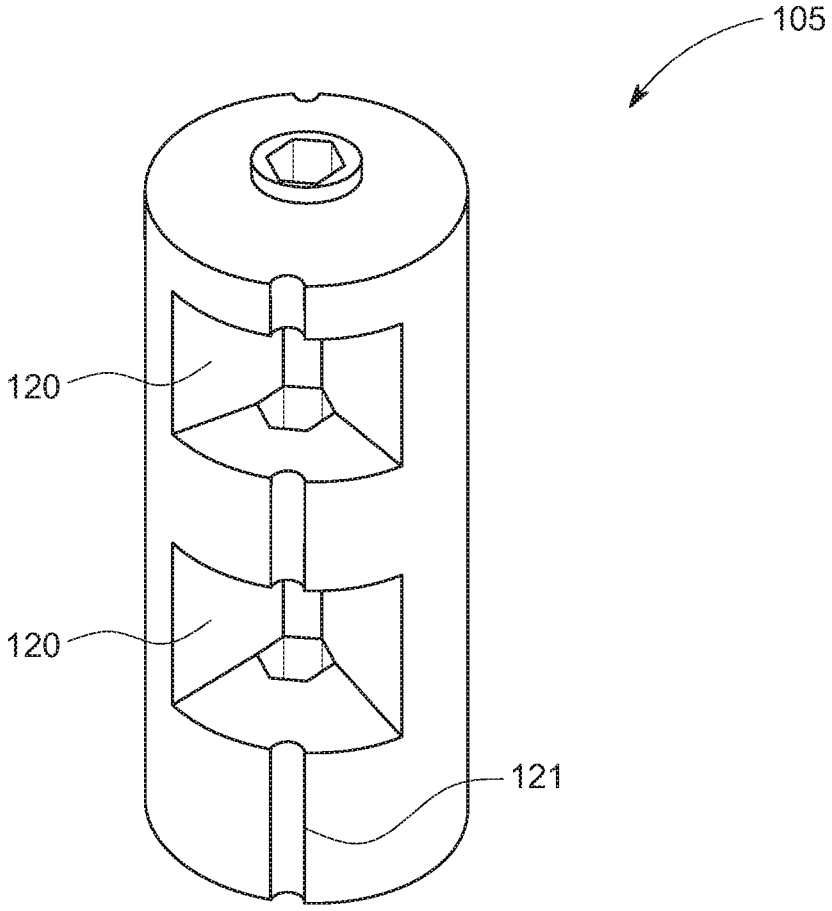
FIG. 7 is a perspective view of a mixer bearing of a chemical mixer tool according to one embodiment of the present invention.
Figure 8:
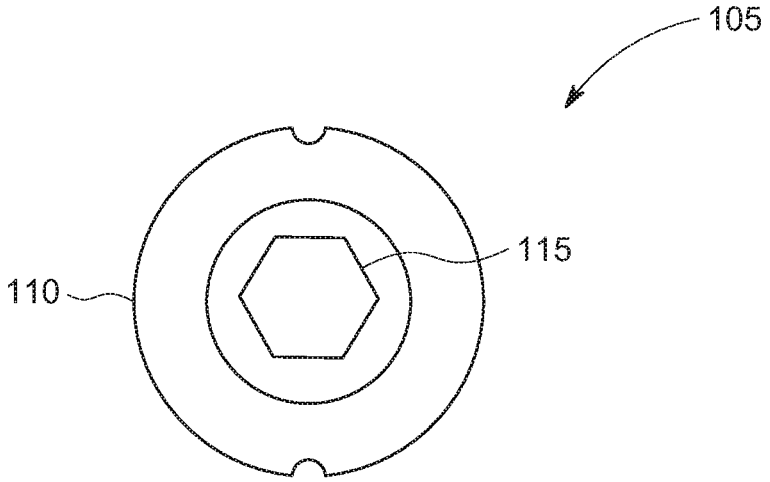
FIG. 8 is a top view of a mixer bearing of a chemical mixer tool according to one embodiment of the present invention.
Figure 9:
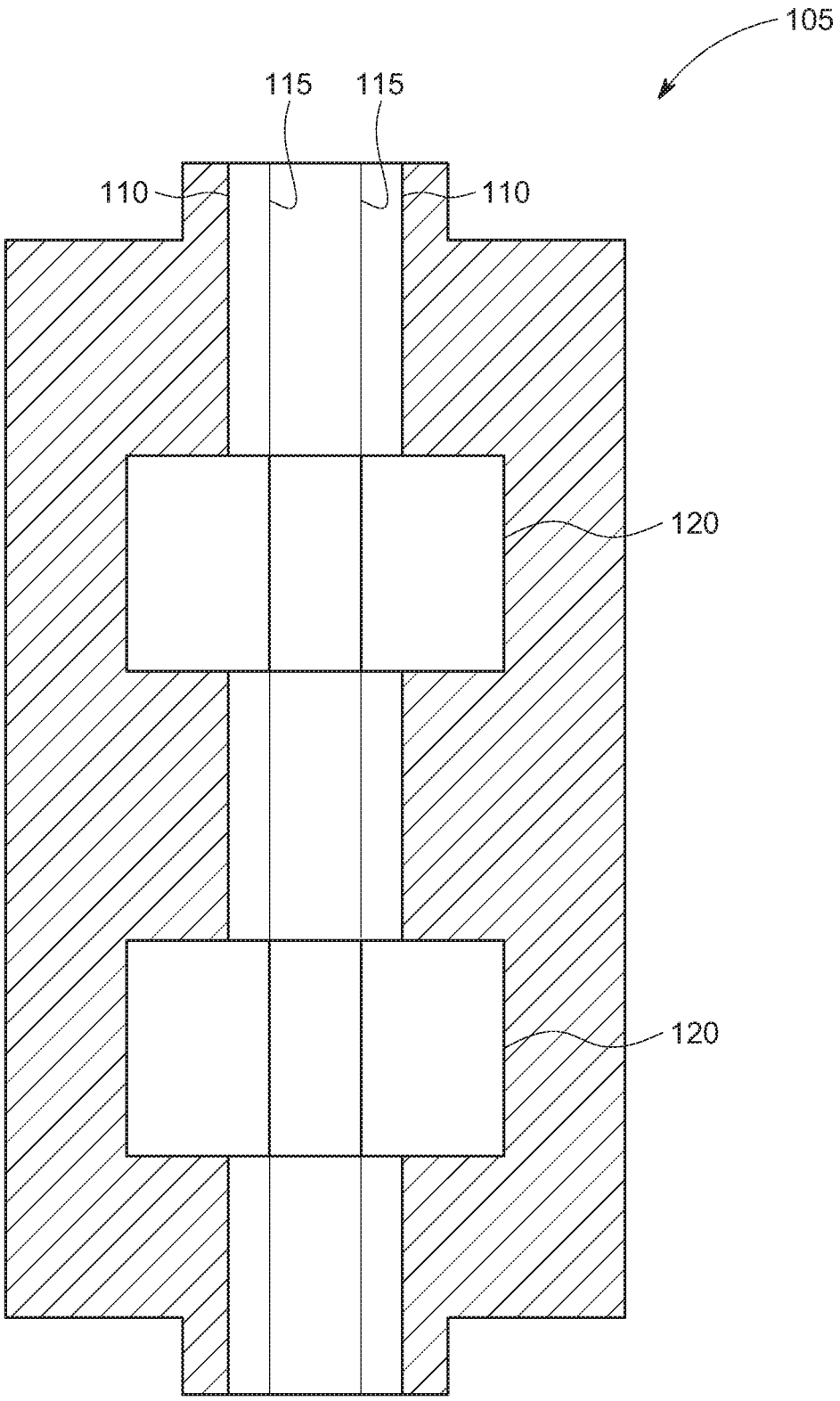
FIG. 9 is a cross-sectional view of a mixer bearing of a chemical mixer tool according to one embodiment of the present invention.

The cylindrical bearing housing 80 is hollow so as to enable a mixer bearing 105 to be rotatably contained therein. As shown in FIGS. 7-9, the mixer bearing 105 is a hollow cylinder with a circular outer ring 110 and an inner bore 115 typically having the same shape as the mixer shaft 20, which is typically hexagonal. In other variations, the inner bore 115 may be cylindrical, with the mixer shaft 20 being hexagonal in shape. As shown in FIGS. 7 and 9, the mixer bearing 105 typically has a plurality of venting windows 120 and external venting channels 121 to dissipate heat as the mixer bearing 105 rotates within the cylindrical bearing housing 80. The venting windows 120 and the venting channels 121 reduce the surface area of the mixer bearing 105 that comes into contact with the inner hollow cavity portion of the cylindrical bearing housing 80, thus reducing friction created when the chemical mixer tool is engaged, and decreasing wear of the cylindrical bearing housing 80. Typically, the venting windows 120 together with the venting channels 121 reduce the surface area of the mixer bearing by an amount between ten percent and sixty percent. Additionally, the configuration of the venting windows 120 allows for the mixer bearing 105 to have a smooth surface when formed with an injection mold. The mixer bearing 105 is typically made from a thermoplastic material, such as acetal polyoxymethylene.

As shown in FIG. 6, the port engagement interface 85 is typically threaded so that it can be threadably received into the mixer port 30, thereby securing the mixer housing assembly 10 to the mixer port 30 of the storage drum 35 (as exemplified in FIG. 1). The port gasket 90 fills the space between the port engagement interface 85 and the mixer port 30 to prevent leakage of the contents within the storage drum 35. To secure the mixer housing assembly 10 to the mixer port 30, the distal end of the chemical mixer tool 5 is inserted into the mixer port 30 and the port engagement interface 85 is threadably received into the mixer port 30. As shown in FIG. 1, when the mixer housing assembly 10 is secured to the mixer port 30, the mixer head stem 75 and the mixer shaft 20 extend distally into the cavity of the storage drum 35.

Figure 4:
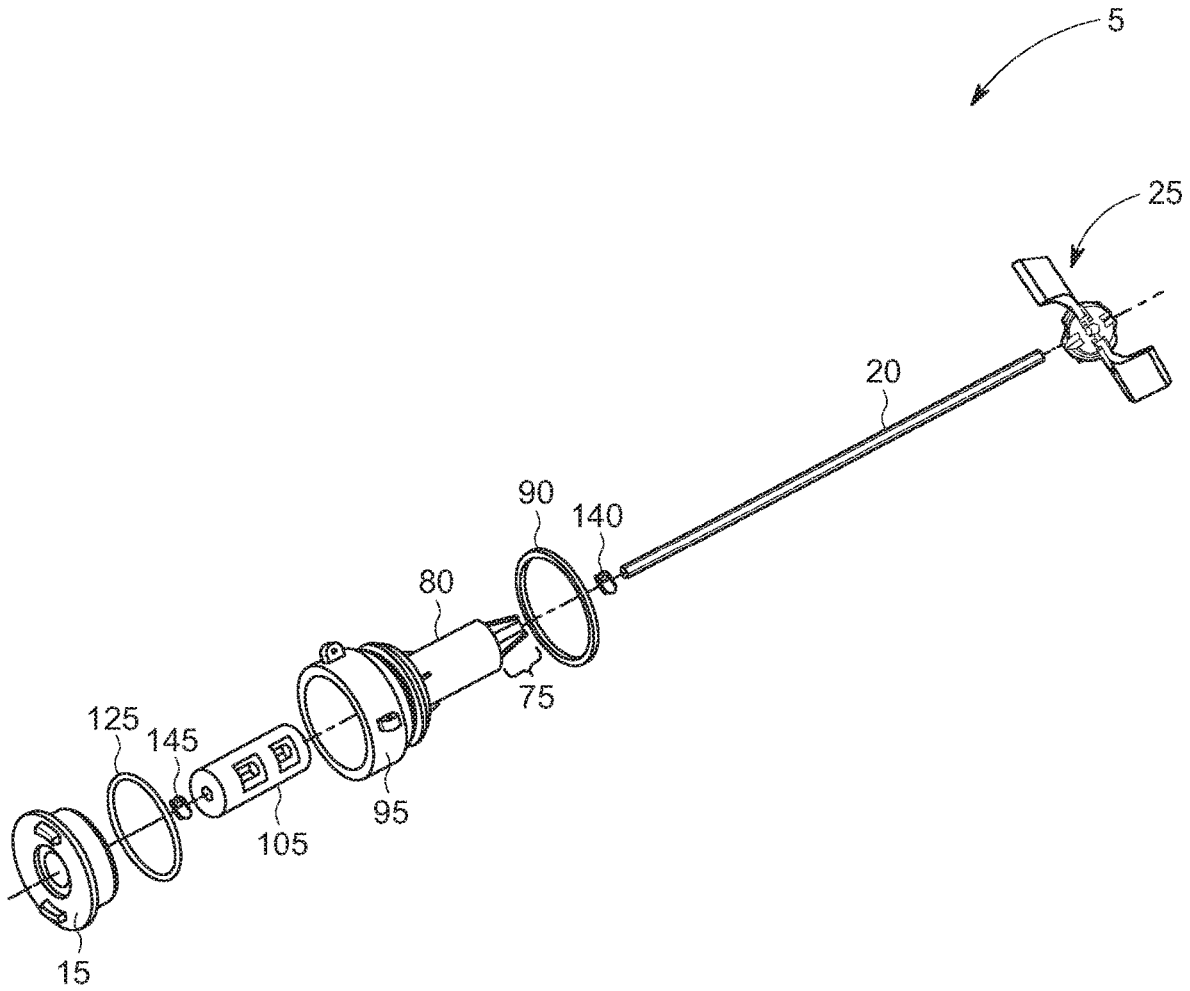
FIG. 4 is an exploded view of a chemical mixer tool according to one embodiment of the present invention.
Figure 5:
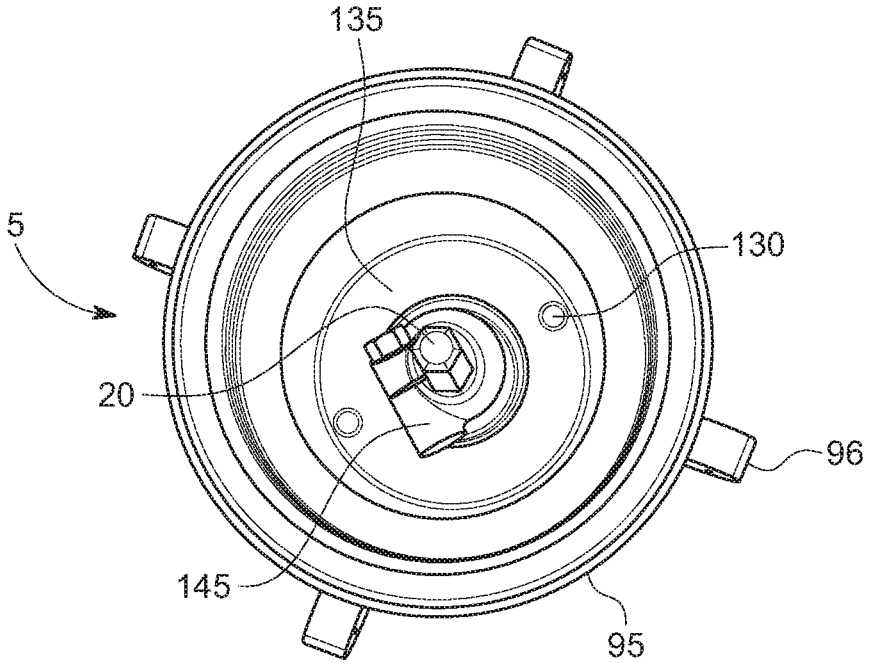
FIG. 5 is a top view of a mixer housing assembly of a chemical mixer tool according to one embodiment of the present invention.

As shown in FIG. 4, the vent cap 15 is typically threaded so as to be threadably received and secured into the grip ring 95. An o-ring 125 is provided on the threads of the vent cap 15 to create a seal at the interface between the vent cap 15 and the grip ring 95, to prevent leakage from the storage drum 35. The vent cap 15 is easily removable, and allows for ventilation of the storage drum 35 while the mixer housing assembly 10 is secured in place, to relieve pressure build-up and to prevent the creation of a vacuum when liquid is extracted from the drum. As seen in FIG. 5, venting holes 130 are provided on the seat 135 of the port engagement interface 85. To vent the storage drum 35 when the mixer housing assembly 10 is secured to the mixer port 30, the vent cap 15 is removed from the grip ring 95, exposing the venting holes 130, thereby allowing ventilation to the storage drum 35. To re-seal the storage drum 35 after ventilation, the vent cap 15 is simply re-threaded and re-secured into the grip ring 95.

As shown in FIGS. 1-4, a mixer shaft 20 extends between the mixer housing assembly 10 and the impeller assembly 25. The proximal end of the mixer shaft 20 is inserted through the mixer head stem 75 and through the inner bore 115 of the mixer bearing 105, and is secured within the mixer housing assembly 10 with two clamps. A first clamp 140 is secured to the mixer shaft 20 at or near the distal end of the mixer head stem 75, and a second clamp 145 is secured to the mixer shaft 20 at or near the seat 135 of the port engagement interface 85. The mixer shaft 20 is typically hexagonal in shape, and made from an anti-corrosive material with high tensile strength, such as stainless steel. The mixer shaft 20 can be engaged with a rotational tool, such as a handheld pneumatic drill, electric drill, or mounted motor, thereby providing the rotational energy to mix the contents of the storage drum 35.

Figure 10:
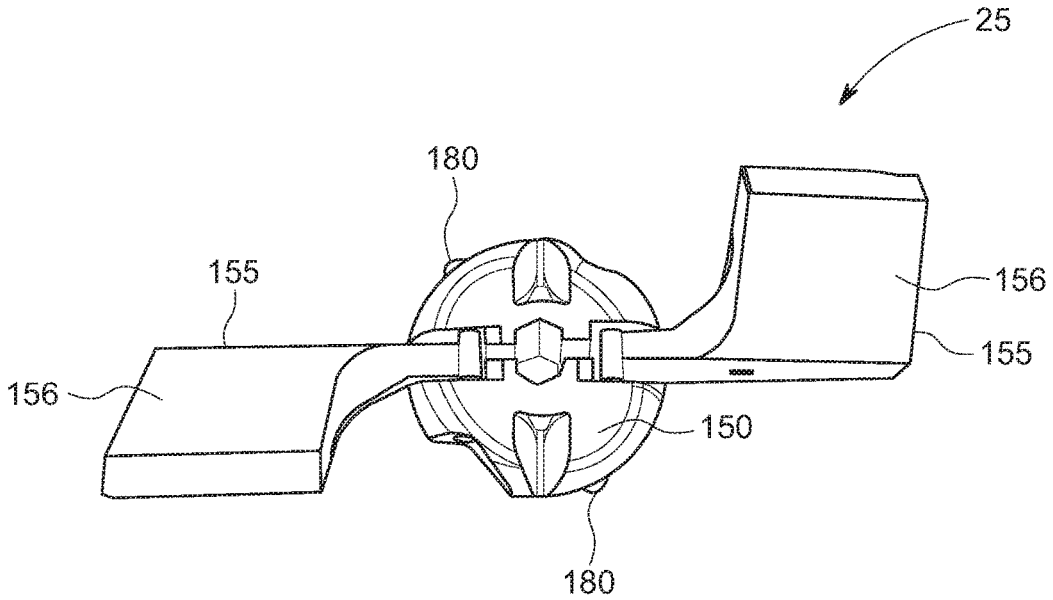
FIG. 10 is a top view of an impeller assembly of a chemical mixer tool according to one embodiment of the present invention.

At least one impeller assembly 25 is placed at the desired location on the portion of the mixer shaft 20 distally extending from the mixer housing assembly 10 and into the storage drum 35. As shown in exemplary FIGS. 2 and 3, two impeller assemblies 25 have been secured to a mixer shaft 20. As shown in FIG. 10, the impeller assembly 25 comprises an impeller collar 150 and at least two pitch blades 155. The pitch blades 155 and impeller collar 150 are each typically made from a reinforced thermoplastic material, such as glass filled polypropylene.

Figure 11:
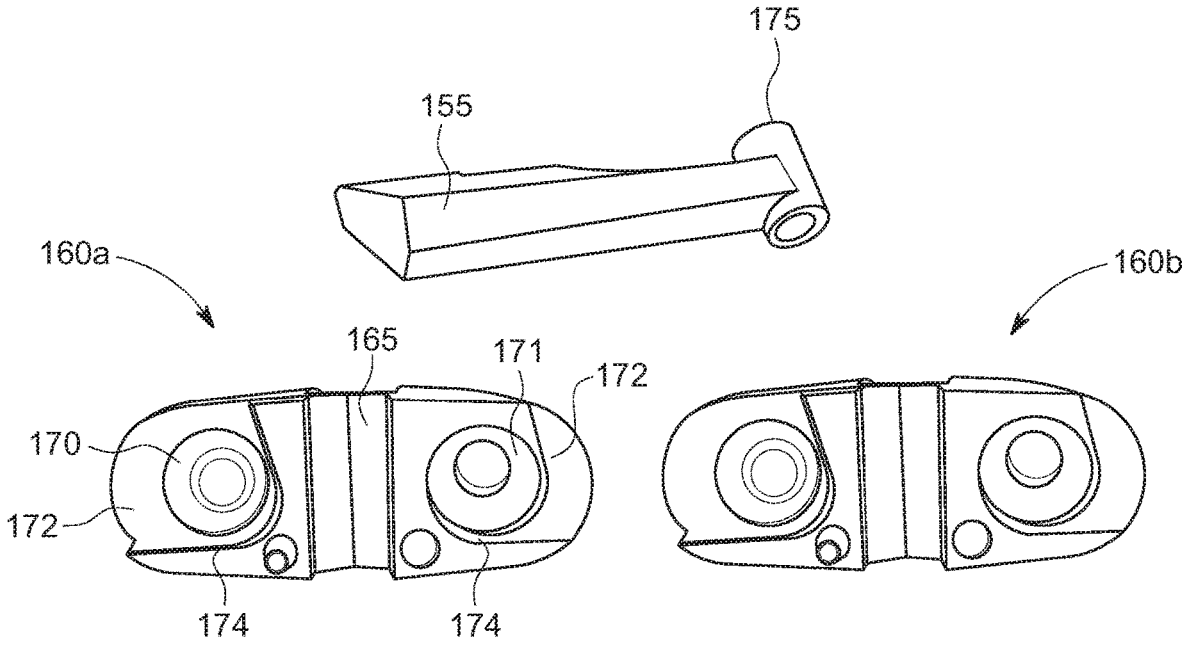
FIG. 11 is a side view of a disassembled impeller collar and pitch blade of a chemical mixer tool according to one embodiment of the present invention.
Figure 12:
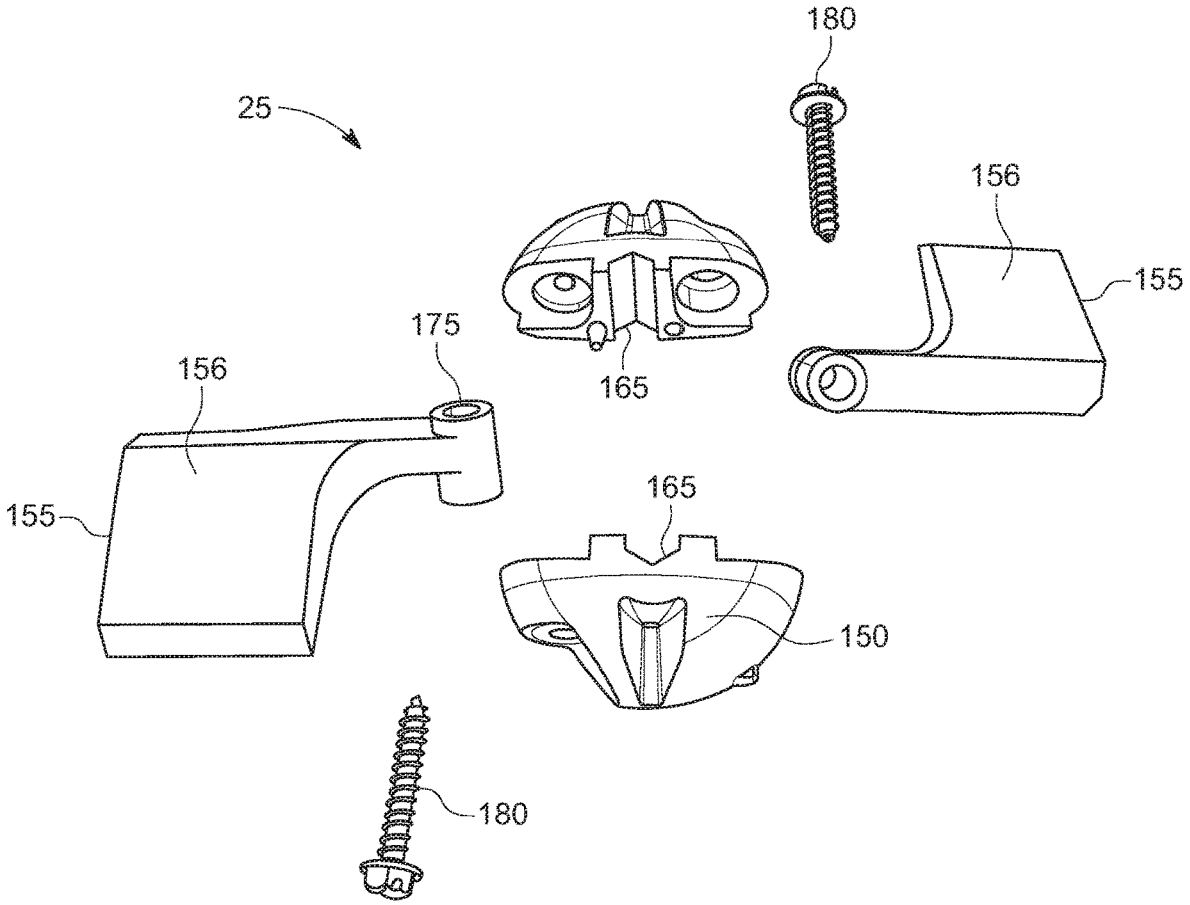
FIG. 12 is an exploded view of an impeller assembly of a chemical mixer tool according to one embodiment of the present invention.

As shown in FIG. 11, the impeller collar 150 is comprised of a first collar half **160*a* and second collar half 160*b*. Each collar half 160*a* and 160*b* contains a channel 165 to hold the mixer shaft 20 therein, a first and second blade slot 170 and 171 having a blade stop 174, and a blade seat 172. As also shown in FIG. 11, the proximal end of the pitch blade 155 comprises a slot stem 175. To form the impeller assembly 25 illustrated in FIG. 10, the slot stem 175 of a first pitch blade 155 is placed in the first blade slot 170 of a first collar half 160*a*, and the slot stem 175 of a second pitch blade 155 is placed in in second blade slot 171** of a second collar half

160*b*. Typically, the two portions of the impeller assembly 25 are then secured to the mixer shaft 20 by joining the first collar half 160*a* to the second collar half 160*b*, and threading a screw 180 through the two collar halves 160*a* and 160*b* at each end.

The blade stop 174 is structured and arranged so as to allow the pitch blades 155 to collapse downwardly when the chemical mixer tool 5 is not engaged, allowing for the chemical mixer tool 5 to be easily removed from the mixer port 30 without limiting the radial length of the pitch blades 155. When the pitch blades 155 are in a collapsed position, as in FIG. 3, the end of the pitch blade 155 proximal to the slot stem 175 rests against the side of the blade stop 174 abutting the channel 165. As the pitch blades 155 are pushed out and away from the mixer shaft 20, the end of the pitch blade 155 proximal to the slot stem 175 moves along the blade seat 172. When the pitch blades 155 are in an outwardly splayed position, as in FIG. 2, the end of the pitch blade 155 proximal to the slot stem 175 rests against the side of the blade stop 174 substantially perpendicular to the channel 165. Typically, the angle of the blade stop 174 is slightly obtuse, or between ninety-five and one hundred twenty degrees.

Figure 3:
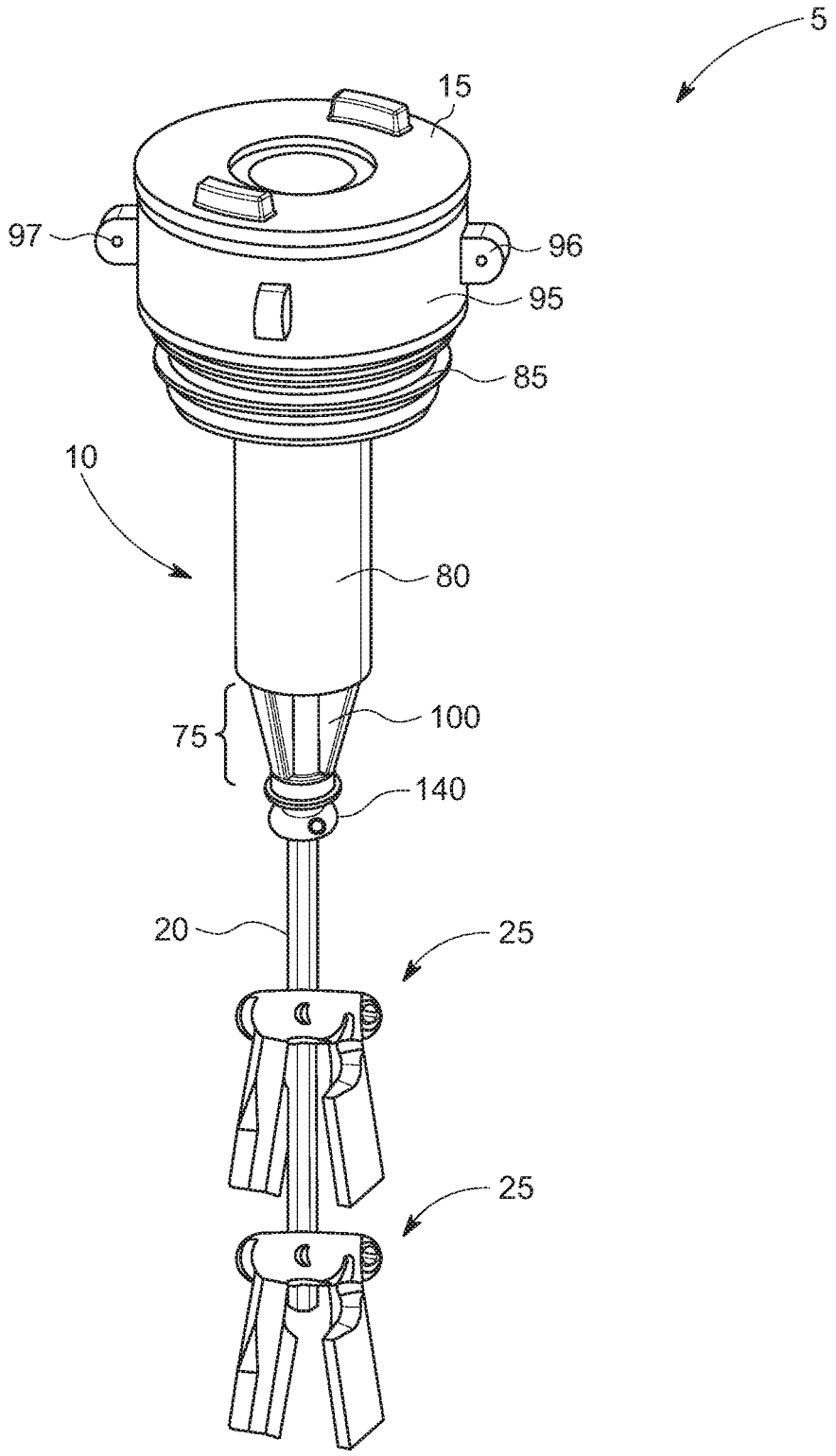
FIG. 3 is a front view of a chemical mixer tool according to one embodiment of the present invention.

While the blade stop 174 enables the pitch blades 155 to collapse, the angle of the blade stop 174 also ensures that even when collapsed, the pitch blades 155 are still angled slightly outwardly and away from the mixer shaft 20, with the inner surface 156 of the pitch blades 155 resting at an angle ranging between five and fifteen degrees off parallel from the mixer shaft 20 (as exemplified in FIG. 3). This arrangement ensures that when the chemical mixer tool 5 is engaged, the liquid within the storage drum 35 can move between the inner surface 156 of the pitch blades 155 and the mixer shaft 20, thus enabling the force created by the moving liquid within the storage drum 35 to push the pitch blades 155 out and away from the mixer shaft 20, rather than pushing the pitch blades 155 towards and into the mixer shaft 20, thereby enabling the pitch blades 155 to create the proper flow for effective and efficient mixing of the storage drum's 35 contents. Otherwise, if the moving liquid pushed the pitch blades 155 towards and into the mixer shaft 20, the pitch blades 155 would not splay outwardly and would therefore be rendered ineffective for mixing the contents of the storage drum 35.

ALTERNATIVE EMBODIMENTS AND VARIATIONS

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A chemical mixer tool for use in mixing the liquid contents in a storage drum comprising:

a mixer housing assembly, said mixer housing assembly configured to removably attach to a top portion of the storage drum and including at least a cylindrical mixer bearing and a cylindrical bearing housing, wherein said mixer bearing is removably received within the cavity of the cylindrical bearing housing and rotatably contained therein, said mixer bearing further including at least one of a venting window and a venting channel;

a mixer shaft having a longitudinal axis, said mixer shaft rotatably coupled to said mixer housing assembly near the proximal end of said mixer shaft; and an impeller assembly including:

an impeller collar, said impeller collar removably attached proximate the distal end of said mixer shaft; and one or more pitch blades having an inner blade surface and said pitch blades rotatably contained within said impeller collar, said impeller collar configured such that said inner blade surface has a resting position canted outwardly no less than 5 degrees off parallel of the longitudinal axis of said mixer shaft and is configured to rotate outwardly from the longitudinal axis of said mixer shaft as said mixer shaft is rotatably engaged.

2. The chemical mixer tool of claim 1 wherein said mixer shaft is hexagonal in shape.

3. The chemical mixer tool of claim 1 wherein said cylindrical bearing housing comprises a thermoplastic material.

4. The chemical mixer tool of claim 1 wherein said mixer bearing comprises a thermoplastic material.

5. A chemical mixer tool for use in mixing the liquid contents in a storage drum comprising:

a mixer housing assembly, said mixer housing assembly configured to removably attach to a top portion of the storage drum and including a first clamp and a second clamp, wherein said first clamp is removably attached to said mixer shaft proximate the distal end of said mixer housing assembly, and said second clamp is removably attached proximate the proximal end of said mixer housing assembly, said first clamp and said second clamp coupling said mixer shaft to said mixer housing assembly;

a mixer shaft having a longitudinal axis, said mixer shaft rotatably coupled to said mixer housing assembly near the proximal end of said mixer shaft; and an impeller assembly including:

an impeller collar, said impeller collar removably attached proximate the distal end of said mixer shaft; and one or more pitch blades having an inner blade surface and said pitch blades rotatably contained within said impeller collar, said impeller collar configured such that said inner blade surface has a resting position canted outwardly no less than 5 degrees off parallel of the longitudinal axis of said mixer shaft and is configured to rotate outwardly from the longitudinal axis of said mixer shaft as said mixer shaft is rotatably engaged.

6. The chemical mixer tool of claim 5 wherein said mixer housing assembly further comprises a vent cap, said vent cap configured to removably attach to the proximal end of said mixer housing assembly.

7. The chemical mixer tool of claim 5 wherein said mixer housing assembly is threadably removably attached to the storage drum.

8. The chemical mixer tool of claim 5 in combination with a storage drum, said storage drum comprising:

a cylindrical outer wall;

a top portion attached to a first end of said cylindrical outer wall; and a bottom sump portion attached to a second end of said cylindrical wall, said bottom sump portion having an oblique conical shape and a frustum base, wherein said frustum base is substantially parallel to said top portion.

9. A chemical mixer tool in combination with a storage drum:

said storage drum comprising:

(1) a cylindrical outer wall;

(2) a top portion attached to a first end of said cylindrical outer wall; and (3) a bottom sump portion attached to a second end of said cylindrical wall, said bottom sump portion having an oblique conical shape and a frustum base, wherein said frustum base is substantially parallel to said top portion; and said chemical mixer comprising:

(a) a mixer housing assembly, said mixer housing assembly removably attached to the top portion of the storage drum;

(b) a mixer shaft having a longitudinal axis, said mixer shaft rotatably coupled to said mixer housing assembly near the proximal end of said mixer shaft; and (c) an impeller assembly including:

(i) an impeller collar, said impeller collar removably attached proximate the distal end of said mixer shaft; and (ii) one or more pitch blades having an inner blade surface and said pitch blades rotatably contained within said impeller collar, said impeller collar configured such that said inner blade surface has a resting position canted outwardly no less than 5 degrees off parallel of the longitudinal axis of said mixer shaft and is configured to rotate outwardly from the longitudinal axis of said mixer shaft as said mixer shaft is rotatably engaged.

10. The combination of claim 9 wherein said storage drum further includes an upper chime extending upwardly and outwardly from said top portion.

11. The combination of claim 9 wherein said mixer shaft is hexagonal in shape.

12. The combination of claim 9 wherein said mixer housing assembly further comprises a first clamp and a second clamp, wherein said first clamp is removably attached to said mixer shaft proximate the distal end of said mixer housing assembly, and said second clamp is removably attached proximate the proximal end of said mixer housing assembly, said first clamp and said second clamp coupling said mixer shaft to said mixer housing assembly.

13. The combination of claim 9 wherein said mixer housing assembly is threadably removably attached to the storage drum.

14. The combination of claim 9 wherein said mixer housing assembly further comprises a vent cap, said vent cap configured to removably attach to the proximal end of said mixer housing assembly.

* * * * *